US007572159B2

(12) United States Patent
Ide et al.

(10) Patent No.: US 7,572,159 B2
(45) Date of Patent: Aug. 11, 2009

(54) INTERNAL COMBUSTION ENGINE INSTALLED IN ENGINE COMPARTMENT

(75) Inventors: Shinichi Ide, Wako (JP); Koji Kasai, Wako (JP); Tetsu Wada, Wako (JP); Tetsuro Ikeno, Wako (JP); Shoji Hasei, Wako (JP); Hiroshi Takahashi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/904,139

(22) Filed: Sep. 26, 2007

(65) Prior Publication Data

US 2008/0081522 A1 Apr. 3, 2008

(30) Foreign Application Priority Data

Sep. 29, 2006 (JP) ..... 2006-270086

(51) Int. Cl.
*B63B 35/73* (2006.01)

(52) U.S. Cl. ..... 440/88 A

(58) Field of Classification Search ..... 440/88 A, 440/88 J, 88 R; 277/606, 626
See application file for complete search history.

(56) References Cited

U.S. PATENT DOCUMENTS 4,375,356 A * 3/1983 Stevens ..... 440/112
5,176,551 A * 1/1993 Blanchard et al. ..... 440/88 R
5,445,547 A * 8/1995 Furukawa ..... 440/88 A
6,139,381 A * 10/2000 Suzuki et al. ..... 440/88 A
6,471,558 B1 * 10/2002 Nakatsuji et al. ..... 440/88 R
7,204,733 B2 * 4/2007 Nash et al. ..... 440/88 A

FOREIGN PATENT DOCUMENTS

JP 59-120598 7/1984
JP 05-286490 11/1993

* cited by examiner

*Primary Examiner*—Lars A Olson
(74) *Attorney, Agent, or Firm*—Carrier, Blackman & Associates, P.C.; William D. Blackman; Joseph P. Carrier

(57) ABSTRACT

An outboard motor has an internal combustion engine installed in an engine compartment defined by an engine cover. The engine's intake air inlet is formed by an air intake duct, which communicates with an air intake space outside the engine compartment. The engine cover includes an upper cover with a receiving ring fitted on the air intake duct. The receiving ring and the intake duct form an overlapping part in which the ring and the duct overlap each other in the direction of flow of combustion air. The overlapping part has a sealing member therein which forms a seal between the air intake space and the interior space of the engine compartment. The sealing structure does not require high dimensional precision to form a required sealing property between the engine cover and the air inlet of the engine intake system. The sealing structure minimizes any influence of engine vibrations.

18 Claims, 8 Drawing Sheets

INTERNAL COMBUSTION ENGINE INSTALLED IN ENGINE COMPARTMENT

BACKGROUND OF THE INVENTION

1. Field of the Invention

The present invention relates to an internal combustion engine installed in an engine compartment covered with an engine cover. The invention relates more specifically to a structure including the engine cover and an air intake part of the engine. The engine is used typically in marine propulsion machines, for example, outboard motors.

2. Description of the Related Art

A typical outboard motor has an internal combustion engine housed in an engine compartment defined by an engine cover. If an intake air inlet of the intake system of the engine opens into the engine compartment, air to be sucked for combustion into the engine will be heated by the heat generated in the engine and sucked into the engine as heated combustion air. As a consequence, the charging efficiency of the engine will be lowered with resultant reduction in engine output. JP 59-120598 A and JP 05-286490 A disclose a technique for improving the charging efficiency, in which it is attempted to suck air outside the engine compartment into the engine.

When the intake air inlet of the intake system of the engine is in communication with the engine compartment, the air pressure within the engine compartment is caused to vary due to intake pulsation of the engine, and the varying air pressure causes the engine cover to vibrate with resultant generation of noises. The vibration can be prevented by providing a sealing member that shuts off communication between the interior of the engine compartment and the intake air inlet of the intake system. In case the sealing member is to be fixedly secured between members which are adjacently disposed in the direction of flow of the combustion air in the intake air inlet, it is required to increase the dimensional accuracy of the adjacent members with respect to the flow direction of the combustion air, for the purpose of providing a reliable sealing property and required sealing forces in the flow direction of the combustion air. Moreover, the sealing property is susceptible to the influence of the vibration since the intake system and the engine cover are caused to vibrate due to the engine operation.

The present invention has been made in view of the above circumstances, and it is an object of the invention to provide a sealing structure between the engine cover and the intake air inlet of the intake system, in which a high dimensional accuracy is not required to secure a required sealing property and in which the sealing property is not susceptible to the influence of the vibration. It is a further object of the invention to provide a sealing structure which can be easily assembled between the engine cover and the intake air inlet of the intake system, by utilizing a position determining means on the engine cover made up of divided cover elements.

SUMMARY OF THE INVENTION

To attain the above objects, the present invention provides an internal combustion engine installed in an engine compartment defined by an engine cover, comprising an engine body having a combustion chamber therein, and an intake system having an intake air passage with an intake air inlet and an intake air outlet to carry combustion gas to the combustion chamber, wherein the intake air inlet is formed by an air intake duct and is in communication with an exterior of the engine compartment; the engine cover is formed with a receiving ring which is fitted on the air intake duct; the receiving ring and the intake duct cooperate to form an overlapping part in which the receiving ring and the intake duct overlap each other in a direction of flow of combustion air; and the overlapping part has a sealing member therein which forms a seal between an exterior of the engine compartment and an interior of the engine compartment.

According to the present invention, the sealing member is provided in the overlapping part in which the receiving ring and the intake duct overlap each other with respect to the direction of flow of the combustion air. Therefore, even when vibration occurs and the receiving ring and the intake duct are vibrated in the direction of flow of the combustion air in a manner to induce relative movement between the receiving ring and the intake duct in the direction of flow of the combustion air, a reliable sealing property of the sealing member can be maintained without requiring a high dimensional accuracy because the dimensions of the receiving ring and the intake duct are predetermined to form the overlapping part and because the relative dimensional restriction to the receiving ring and the intake duct prevents relative movement in the overlapping part and the sealing member secured to the overlapping part maintains a sealing condition between the receiving ring and the intake duct. The relative dimensional restriction serves to provide a sealing structure which is not susceptible to the influence of vibrations. Further, since there is maintained a stable sealing property between the engine cover and the intake duct, noises caused by engine cover vibration due to the intake pulsation are prevented from being transmitted to the surrounding since the good sealing property is stably maintained between the engine cover and the intake duct.

In a preferred embodiment of the invention, the engine cover includes a first cover secured to the engine body to which the intake system is attached, and a second cover detachably attached to the first cover at a predetermined position in a manner guided by a positioning guide means, the receiving ring is provided on the second cover, and the sealing member is provided on at least one of the intake duct and the receiving ring, arrangement being such that the second cover is guided by the positioning guide means toward the first cover to cause the receiving ring to fit on the intake duct to form the overlapping part when the second cover reaches the predetermined position.

According to this feature, the second cover is guided by the positioning guide means toward the first cover when the second cover is attached to the first cover secured to the engine body. When this assembling work is being performed, the receiving ring forming part of the second cover is automatically positioned relative to the intake duct of the intake system, to form the overlapping part. The overlapping part is automatically formed during the course in which the second cover is being guided by the positioning guide means to the predetermined position. During this course, the sealing structure is automatically obtained in which the sealing member forms a seal between the receiving ring and the intake duct. It will be noted that the sealing structure is automatically formed during the assembling work of the first and second covers and the assembling work is easy.

The sealing member may include a base part and flexible lips formed on the base part, and the base part may be fitted on the receiving ring and the flexible lips are in sealing contact with the intake duct.

In a preferred form, the receiving ring is positioned outside the intake duct, and the air intake duct extends into the exterior of the engine compartment.

DESCRIPTION OF THE PREFERRED EMBODIMENTS

An outboard motor in a preferred embodiment of the present invention will be described with reference to FIGS. 1 to 8.

Figure 1:
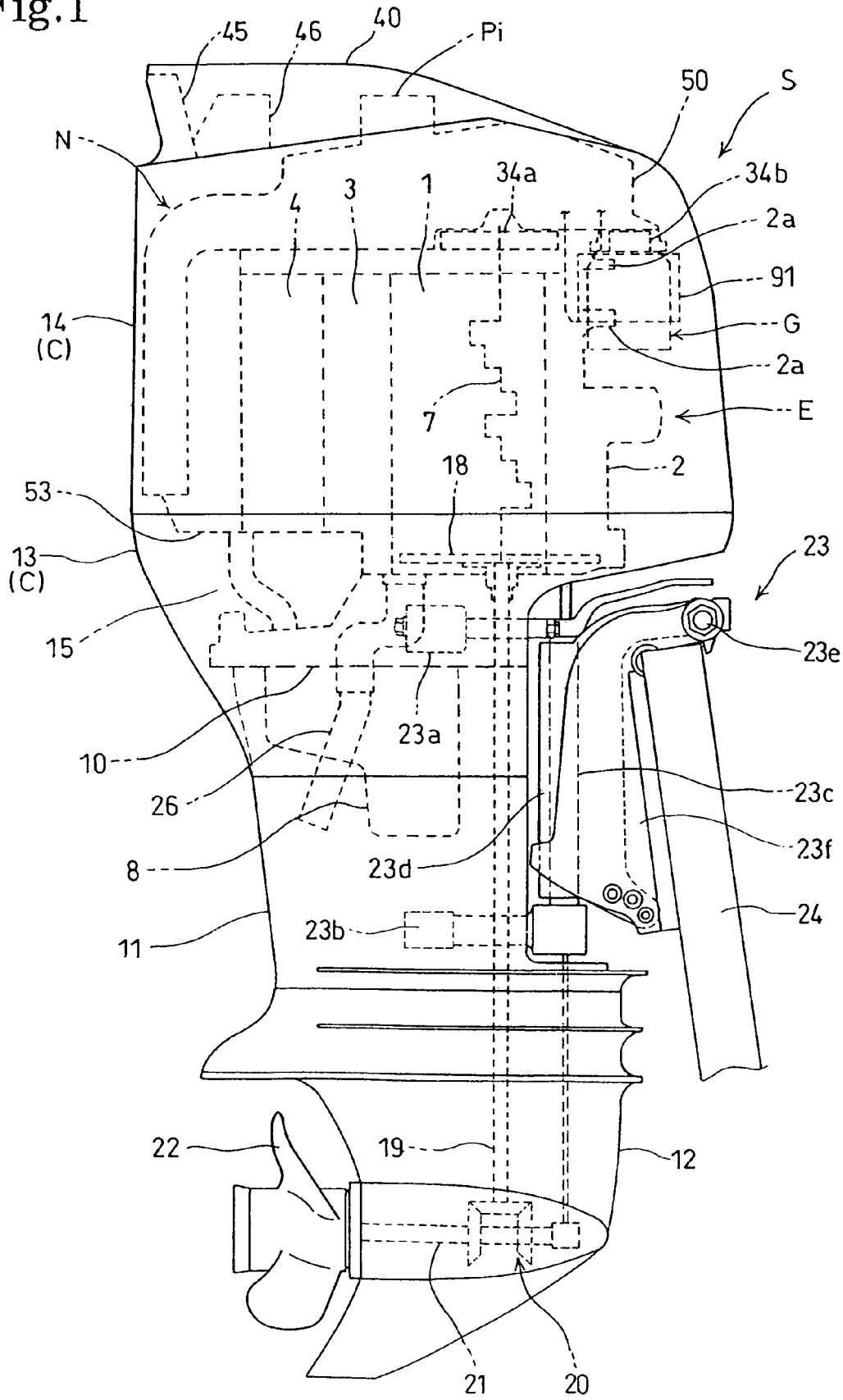
FIG. 1 is a side elevation of an outboard motor embodying the present invention taken from the right-hand-side of the outboard motor.
Figure 2:
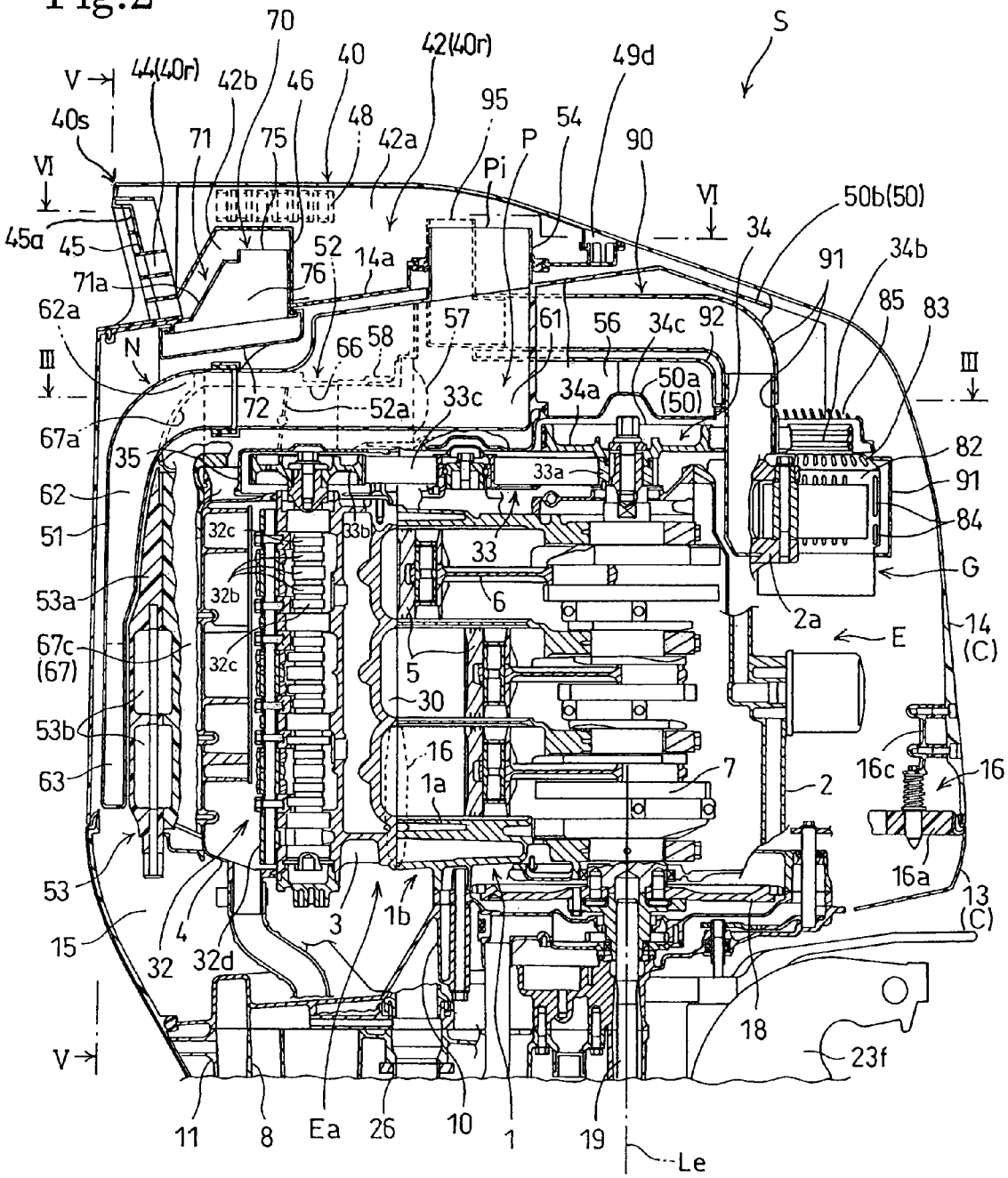
FIG. 2 is a sectional view of an essential part of the outboard motor shown in FIG. 1.

Referring to FIGS. 1 and 2, an outboard motor S, namely, a marine propulsion apparatus as a machine to which the present invention is applied, includes a propulsion unit, namely, a power unit, and a mounting device 23 for holding the propulsion unit on a hull 24. The propulsion unit includes an internal combustion engine E, a propeller unit driven by the internal combustion engine E to generate thrust, an alternator G, cases 10, 11 and 12, and an engine cover C.

Figure 3:
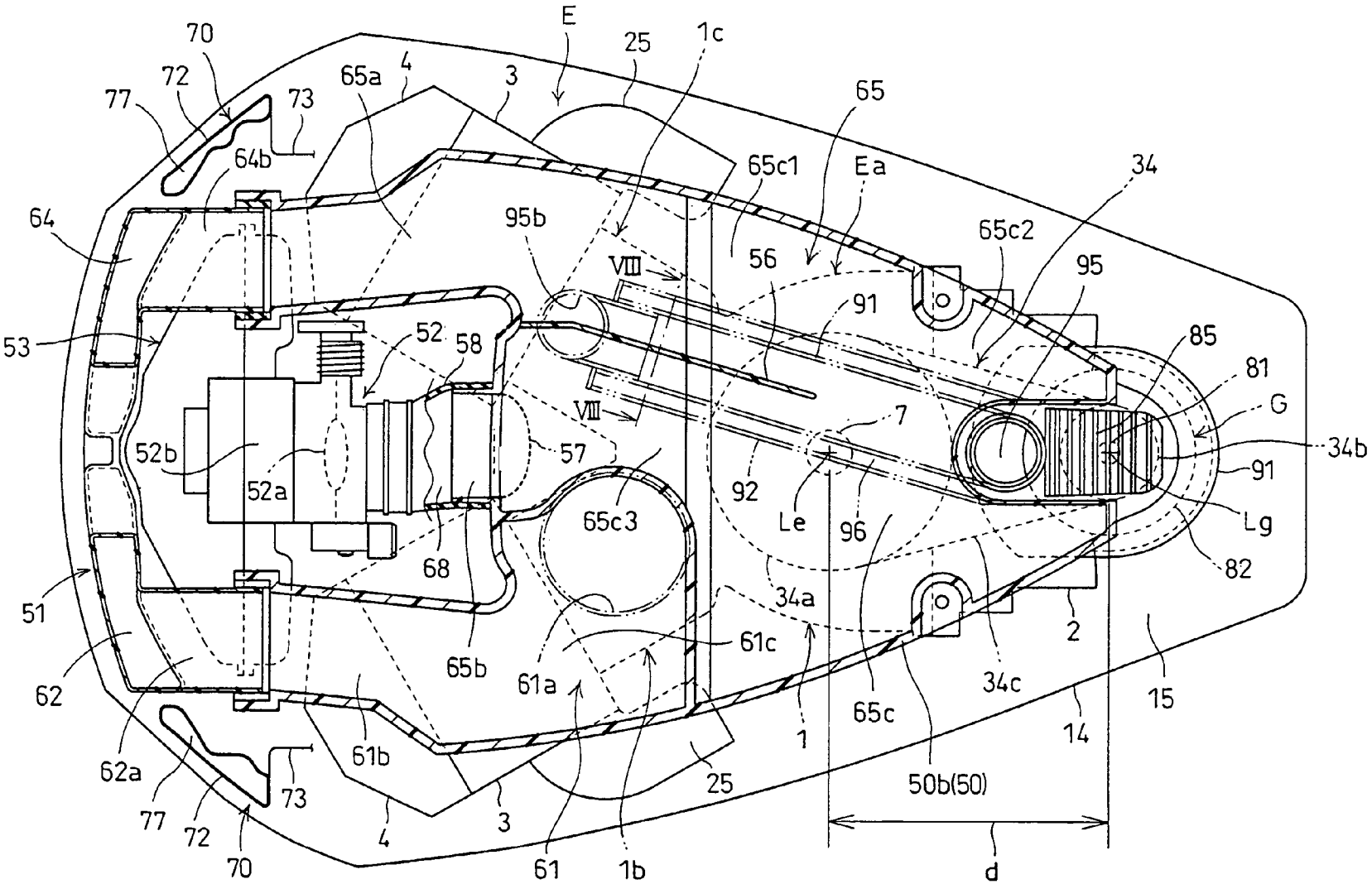
FIG. 3 is a sectional view taken substantially on the line III-III in FIG. 2.

Referring also to FIG. 3, the internal combustion engine E is a vertical, water-cooled multicylinder 4-stroke internal combustion engine provided with a vertical crankshaft 7 disposed with its center axis Le set in a vertical position. In this embodiment, the internal combustion engine E is a V-6 internal combustion engine. The internal combustion engine E has an engine body Ea including a cylinder block 1 provided with two banks 1*b* and 1*c* set at an angle to form a V, a crankcase 2 joined to the front end of the cylinder block 1, a cylinder head 3 joined to the respective rear ends of the banks 1*b* and 1*c* of the cylinder block 1, and a head cover 4 joined to the rear end of the cylinder head 3. The crankshaft 7 is supported for rotation on the cylinder block 1 and is connected to pistons 5 by connecting rods 6.

In the description, an expression: "as seen in plan view" signifies viewing in a vertical direction. In a state shown in FIG. 1, the center axis Le of the crankshaft 7 is vertical, horizontal directions perpendicular to the vertical direction include forward and rearward longitudinal directions and rightward and leftward lateral directions. The vertical directions, the longitudinal directions and the lateral directions coincide with those with respect to the hull 24, respectively. The longitudinal directions and the lateral directions perpendicular to the longitudinal directions are first and second horizontal directions, respectively.

The engine body Ea is joined to the upper end of the mount case 10. An oil pan 8 and the extension case 11 surrounding the oil pan 8 are joined to the lower end of the mount case 10. A gear case 12 is joined to the lower end of the extension case 11. A lower end part of the internal combustion engine E, the mount case 10 and an upper part of the extension case 11 are covered with a lower cover 13, namely, a first cover, connected to the extension case 11. An upper cover 14, namely, a second cover, covering most part of an upper portion of the internal combustion engine E, is connected to the upper end of the lower cover 13. The lower cover 13 and the upper cover 14 forms the split engine cover C defining an engine compartment 15 encasing the internal combustion engine E. Installed in addition to the internal combustion engine E in the engine compartment 15 are a ventilation system 70 for supplying ventilation air into the engine compartment 15, and the alternator G.

Figure 4:
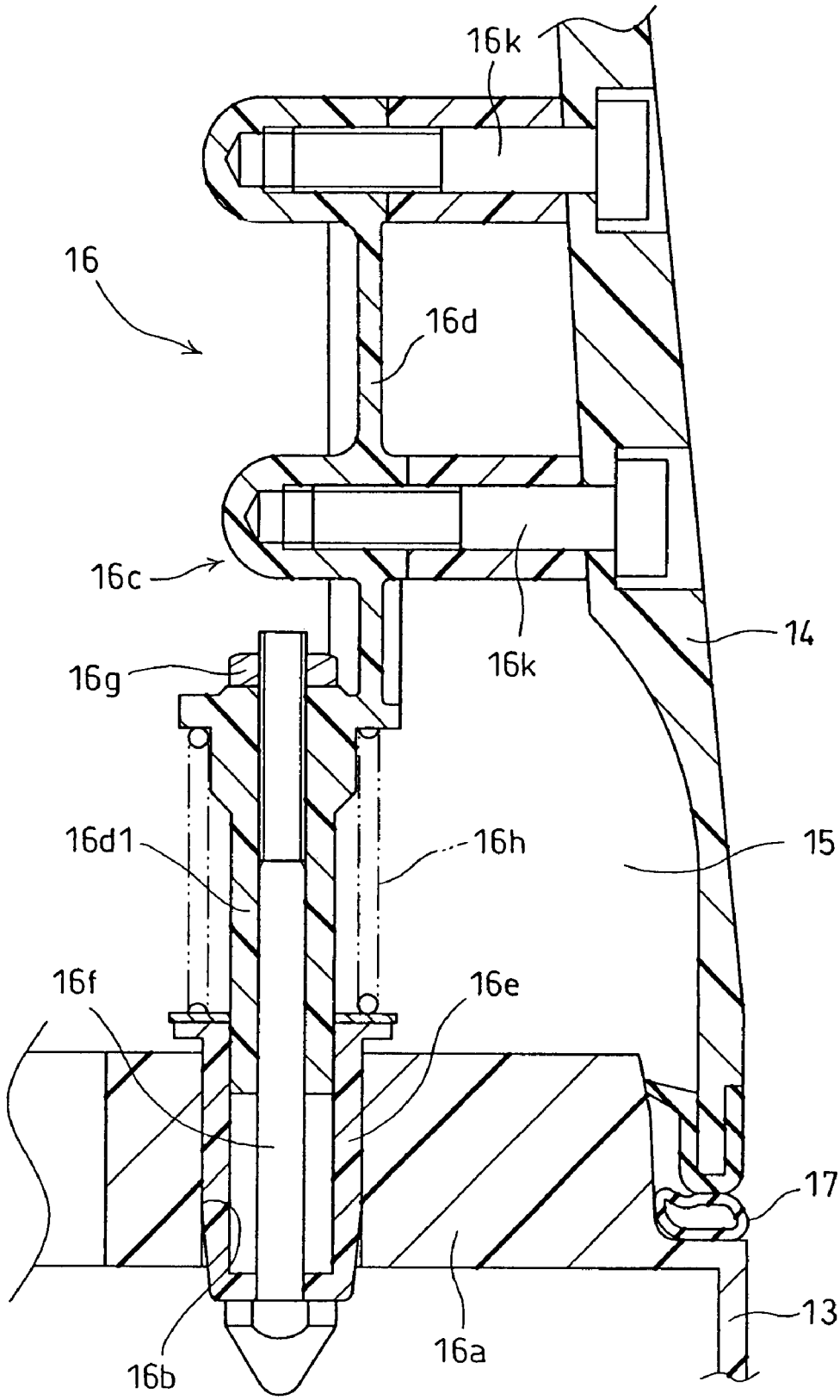
FIG. 4 is an enlarged view of a part, including an engine cover locking device, of FIG. 2.

Referring to FIG. 2, the lower cover 13 is fixedly held on the engine body Ea by the extension case 11 and the mount case 10. The upper cover 14 is detachably attached to the lower case 13 and held in place by plural locking devices 16 serving also as positioning devices. In this embodiment the number of the locking devices 16 is four. The four locking devices 16 are arranged at intervals on the joint of the lower cover 13 and the upper cover 14. As shown in FIG. 4, each of the locking devices 16 includes a first locking member 16*a* projecting from the inside surface of an upper end part of the lower cover 13 and provided with a guide hole 16*b*, and a second locking member 16*c* projecting from the inside surface of a lower end part of the upper cover 14 so as to be inserted into the guide hole 16*b*. The second locking member 16*c* has a fixed part 16*d* having a support part 16*d*1 and fastened to the upper cover 14 with screws 16*k*, a cylindrical moving part 16*e* axially slidably put on the support part 16*d*1 of the fixed part 16*d*, a bolt 16*f* extending through the support part 16*d*1 and the moving part 16*e*, a nut 16*g* screwed on the bolt 16*f*, and a spring 16*h* extending between the fixed part 16*d* and the moving part 16*e* to push the moving part 16*e* away from the fixed part 16*d*.

The second locking members 16*c* attached to the upper cover 14 are inserted in the guide holes 16*b* to join the upper cover 14 to the lower cover 13. Then, the moving parts 16*e* is guided by and moved in the guide holes 16*b* to position the upper cover 13 in place on the lower cover 13 and to join the upper cover 14 to the lower cover 13. A gap between the lower cover 13 and the upper cover 14 is sealed by a sealing member 17. The vertical size of the gap can be adjusted by adjusting the respective positions of the support parts 16*d*1 relative to the corresponding moving parts 16*e* by turning the nuts 16*g*.

Referring to FIGS. 1 and 2, a flywheel 18 is mounted on the lower end part of the crankshaft 7, namely, the output shaft of the internal combustion engine E, and a drive shaft 19 is coupled with the lower end part of the crankshaft 7. The drive shaft 19 driven for rotation by the internal combustion engine E extends downward through the mount case 10 and the extension case 11 into the gear case 12. The drive shaft 19 is interlocked with a propeller shaft 21 by a reversing mechanism 20 held in the gear case 12. The power of the internal combustion engine E is transmitted by the crankshaft 7, the drive shaft 19, the reversing mechanism 20 and the propeller shaft 21 to a propeller 22 mounted on the propeller shaft 21 to rotate the propeller 22. The drive shaft 19, the reversing mechanism 20, the propeller shaft 21 and the propeller 22 constitute the propulsion unit.

The mounting device 23 includes a swivel case 23*d* mounted so as to be turnable on a swivel shaft 23*c* fixedly held by mount rubbers 23*a* and 23*b* on the mount case 10 and the extension case 11, a tilt shaft 23*e* supporting the swivel case 23*d* so as to be tiltable, and a bracket 23*f* holding the tilt shaft 23*e* and fixed to the stem of the hull 24. The propulsion unit of the outboard motor S is held by the mounting device 23 on the hull 24. The propulsion unit can be turned on the tilt shaft 23*e* in a vertical plane and is turnable on the swivel shaft 23*d* in a horizontal plane.

Referring to FIG. 2, the cylinder head 3 is provided with combustion chambers 30 (FIG. 5) respectively axially corresponding to the pistons 5 fitted in cylinders 1*a*, intake ports 31 (FIG. 3) opening respectively into the combustion chambers 30, exhaust ports opening respectively into the combustion chambers, and spark plugs exposed respectively to the combustion chambers 30. Intake valves and exhaust valves incorporated into the cylinder head 3 to open and close the intake ports and the exhaust ports, respectively, are driven for opening and closing operations in synchronism with the rotation of the crankshaft 7 by an overhead-camshaft valve moving mechanism 32 installed in a valve chamber defined by the cylinder head 3 and the head cover 4.

The valve moving mechanism 32 includes camshafts 32*a* driven for rotation by the power of the crankshaft 7 transmitted thereto by a transmission mechanism 33, intake cams 32*b* and exhaust cams 32*c* formed on the camshafts 32*a*, a pair of rocker arm shafts 32*d*, intake rocker arms and exhaust rocker arms supported for turning on the rocker arm shafts 32*d*. The intake cams 32*b* and the exhaust cams 32*c* drive the intake valves and the exhaust valves for opening and closing operation through the intake rocker arms and the exhaust rocker arms, respectively.

Referring to FIG. 3, a drive pulley 33*a* and a drive pulley 34*a* are mounted in that order in an upward arrangement on the upper end part of the crankshaft 7. The transmission mechanism 33 including the drive pulley 33*a*, a cam pulley 33*b* mounted on the camshaft 32*a* and a belt 33*c* extending between the drive pulley 33*a* and the cam pulley 33*b*, and a transmission mechanism 34 including the drive pulley 34*a*, a driven pulley 34*b* mounted on the shaft 81 of the alternator G and a belt 34*c* extending between the drive pulley 34*c* and the driven pulley 34*b*, are disposed in a transmission chamber covered with a belt cover, namely, a transmission cover, attached to the upper end of the engine body Ea. The belt cover includes first belt covers 35 disposed above the upper ends of the cylinder heads 3 mainly for covering the cam pulleys 33*b*, and a lower case 50*a* serving also as a second belt cover disposed above the upper end parts of the cylinder blocks 1 to cover the drive pulleys 33*a* and 34*a* and driven pulley 34*b*.

The shaft 81 driven for rotation through the transmission mechanism 34 by the crankshaft 7 is disposed with the center axis Lg of the shaft 81 spaced a predetermined center distance d apart from the center axis Le of the crankshaft 7.

Fuel sprayed out by a fuel injection valve, namely, an air-fuel mixture producing means, attached to the cylinder head 3 is mixed with the combustion air flowing through an intake air passage P (FIGS. 2 and 3) formed in an intake system N installed in the engine compartment 15 to produce an air-fuel mixture. The air-fuel mixture burns in the combustion chamber 30 when the same is ignited by the spark plug attached to the cylinder head 3. The piston 5 is driven for reciprocation by the pressure of a combustion gas produced in the combustion chamber 30 to drive the crankshaft 7 for rotation through the connecting rod 6. The combustion gas discharged as an exhaust gas through the exhaust port from the combustion chamber 30 flows through an exhaust manifold 25 (FIG. 3) into an exhaust pipe 26 (FIG. 1). Then the exhaust gas flows from the exhaust pipe 26 through an exhaust passage formed in the extension case 11, the gear case 12 and the boss of the propeller 22 and is discharged to the outside of the outboard motor S.

Figure 5:
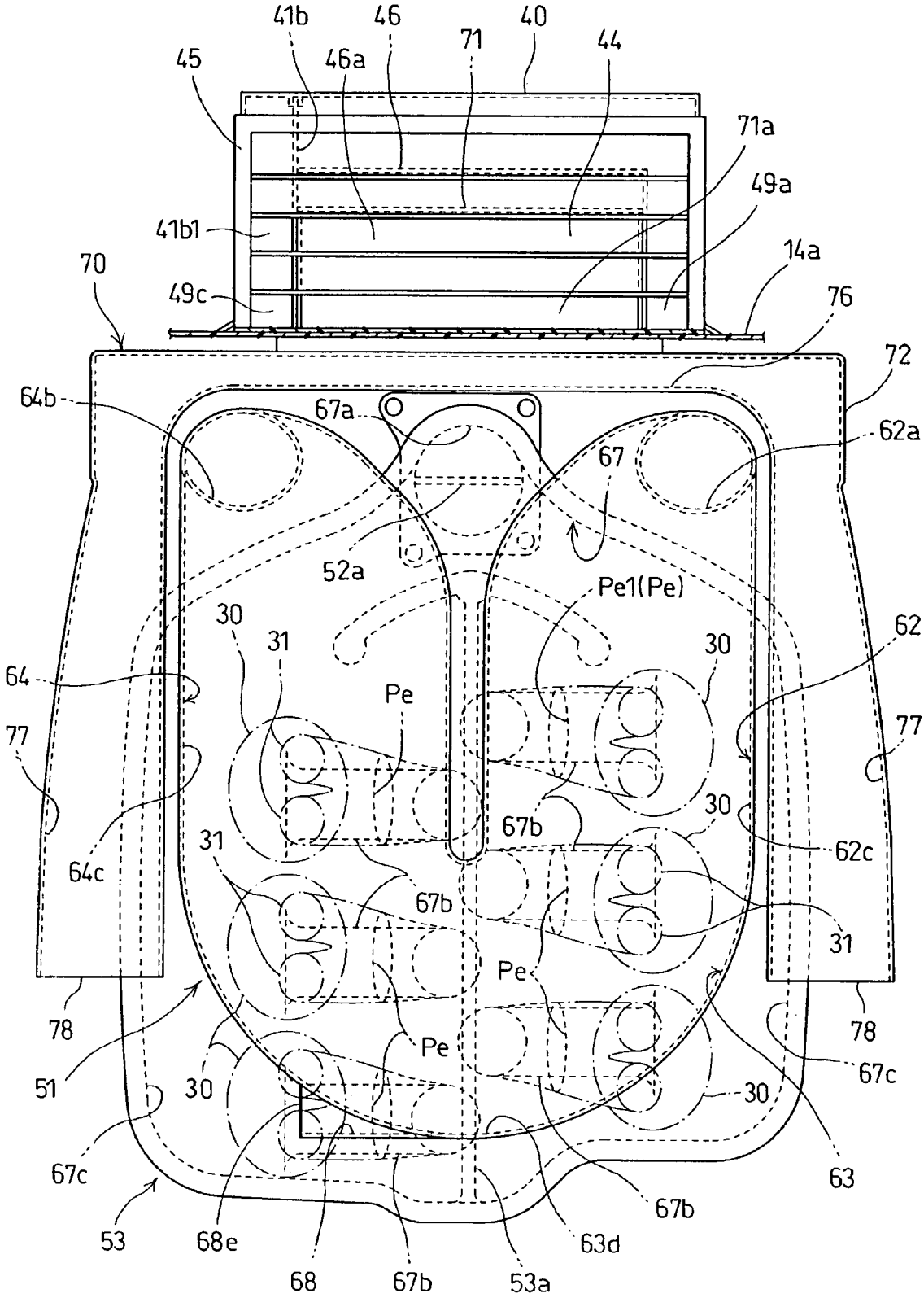
FIG. 5 is a sectional view taken substantially on the line V-V in FIG. 2.
Figure 6:
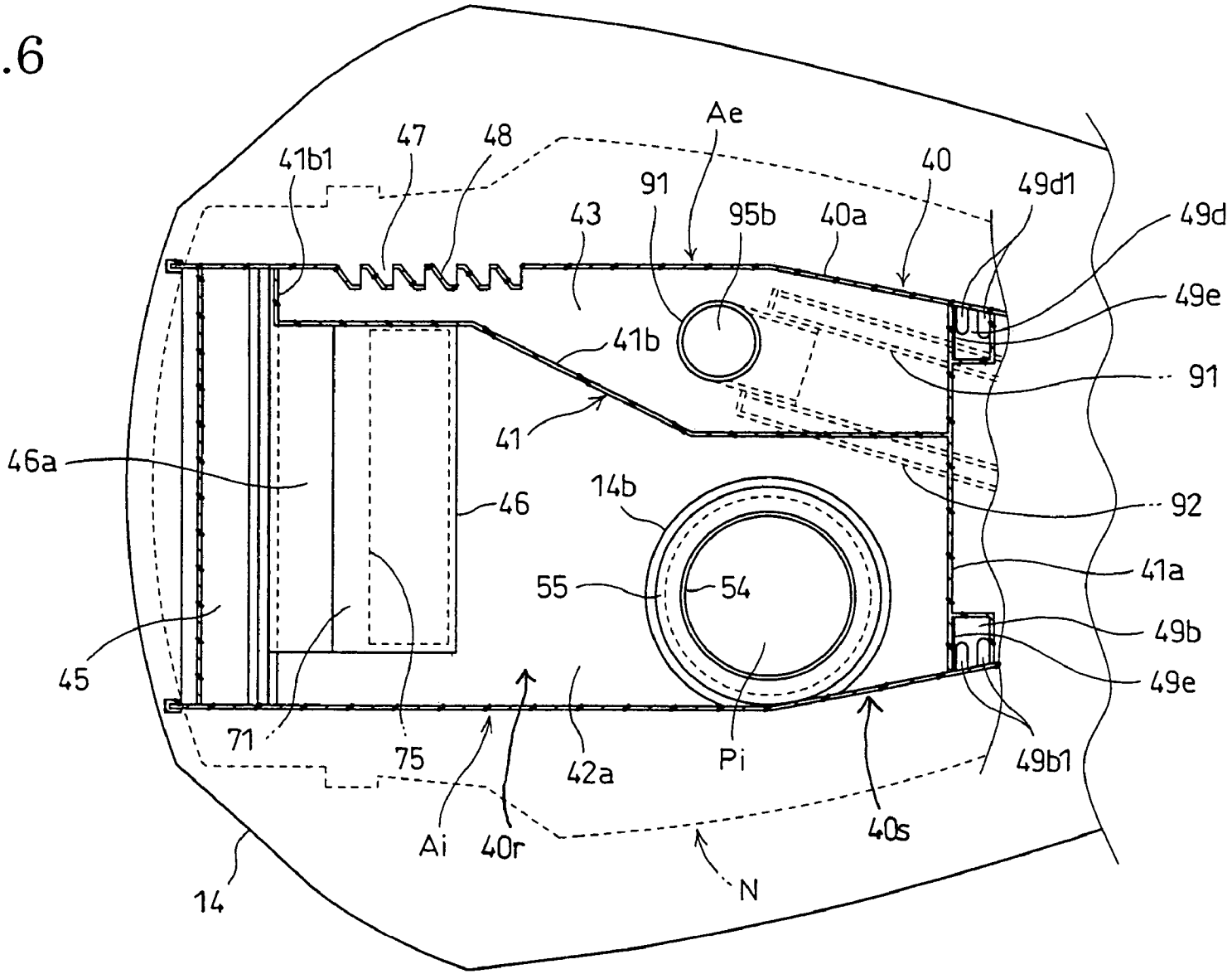
FIG. 6 is a sectional view taken substantially on the line VI-VI in FIG. 2.

Referring to FIGS. 2, 5 and 6, particularly to FIG. 6, an air supply and exhaust system includes an outside-air intake structure Ai for taking outside air surrounding the outboard motor S into the outboard motor S and an air exhaust structure Ae for discharging air from the outboard motor S to the outside. The air supply and exhaust system is disposed outside the upper cover 14 (or the engine compartment 15). The air supply and exhaust system includes an exterior cover 40 extended over and detachably attached to the top wall 14*a* (FIG. 2) of the upper cover 14. The exterior cover 40 may also be referred to as an exterior cap member 40, due to its placement as a cap over the top of the upper cover 14. The air supply and exhaust system further includes a wall member 41 dividing a space defined by the exterior cap member 40 and the top wall 14*a* into an air intake space 42 (FIG. 2) and an air exhaust space 43. The wall member 41 is connected to the exterior cover 40 and the top wall 14*a* by a fitting structure. The wall member 41 is fixedly joined to the top wall 14*a* when the exterior cap member 40 is detachably fastened to the top wall 14 with screws. The wall member 41 has a front lateral wall 41*a* extending in a front zone of the space, and a longitudinal partition wall 41*b* laterally separating the air intake space 42 (FIG. 2) and the air exhaust space 43 from each other. The wall member 41 may be formed integrally with the exterior cap member 40 or the top wall 14*a*.

The outside-air intake structure Ai includes the exterior cover 40, the front wall 41*a*, the partition wall 41*b*, an entrance louver 45, namely, an air current straightening member, disposed at an air inlet 44 (FIG. 2), and a deflector 46 dividing the air intake space 42 into a first space 42*a* through which the combustion air is supplied to the internal combustion engine E and a second space 42*b* (FIG. 2) through which ventilation air flows into the engine compartment 15. The entrance louver 45 is joined to the partition wall 41*b* and the top wall 14*a*. The deflector 46 is formed integrally with the partition wall 41*b*.

The air intake space 42 is defined by the exterior cover 40, the top wall 14*a*, the front wall 41*a* and the partition wall 41*b*. The air inlet 44 (FIG. 2) of the air intake space 42 opens rearward. The entrance louver 45 has a wall 45*a* (FIG. 2) which determines the vertical size of the air inlet 44 such that the passage area of the air inlet 44 is set to be smaller than the passage area of the first space 42*a*. Thus the air intake space 42 constitutes an intake silencing chamber 40*r* having the air inlet 44 as air introducing means and an air expansion chamber connected to the air inlet 44. The exterior cover 40, the upper cover 14 having the top wall 14*a*, the entrance louver 45 and the wall member 41 including the front wall 41*a* and the partition wall 41*b* constitute an exterior intake silencer 40*s* located outside the engine compartment 15 and including the intake silencing chamber 40*r* communicating with an intake air inlet Pi to be described later to conduct combustion air to the air intake passage P. The exterior intake silencer 40*s* can be detached together with the upper cover 14 from the intake system N. The exterior intake silencer 40*s* overlaps a major portion of an intake silencer 50 to be described later when seen in plan view.

The deflector 46 disposed in the air intake space 42 is a box-shaped member having an inclined deflecting wall 46*a* having a flat surface inclined so as to deflect the flow of outside air that has passed through the entrance louver 45, namely, the combustion air, obliquely upward. A ventilation duct 71 is disposed in the second space 42*b* demarcated by the deflector 46. The ventilation duct 71 has an inclined deflecting wall 71*a* having a flat surface inclined so as to deflect obliquely upward the flow of the outside air that has flowed through the lowermost part of the air inlet 44, which is vertically divided into parts by the entrance louver 45. Water contained in the outside air impinges on the deflecting walls 46*a* and 71*a* and is separated from the outside air. Consequently, the amount of water contained in the combustion air flowing downstream from the deflector 46 is reduced, the flow of water into the intake air passage P is suppressed, the amount of water contained in the ventilation air that flows into the ventilation duct 71 is reduced, and the flow of water into the engine compartment 15 is suppressed.

Thus the ventilation air flows into the engine compartment 15 separately from the combustion air that is supplied to the internal combustion engine E.

The air exhaust structure Ae includes the exterior cover 40, the front wall 41*a*, the partition wall 41*b*, and an exit louver 48. The exit louver 48 serves as an air guide member disposed at an air exit 47 through which air in the air exhaust space 43 is discharged. The air exhaust space 43 is defined by the exterior cover 40, the top wall 14*a*, the front wall 41*a* and the partition wall 41*b*. The air exit 47 of the air exhaust space 43 is formed in the left side wall 40*a* so as to open leftward. The exit louver 48 is formed integrally with the left side wall 40*a*. A rear part of the air exhaust space 43 excluding a drain passage 49*c* (FIG. 5) formed in the lowermost part of the entrance louver 45 is closed by a rear part 41*b*1 of the partition wall 41*b*.

Figure 7:
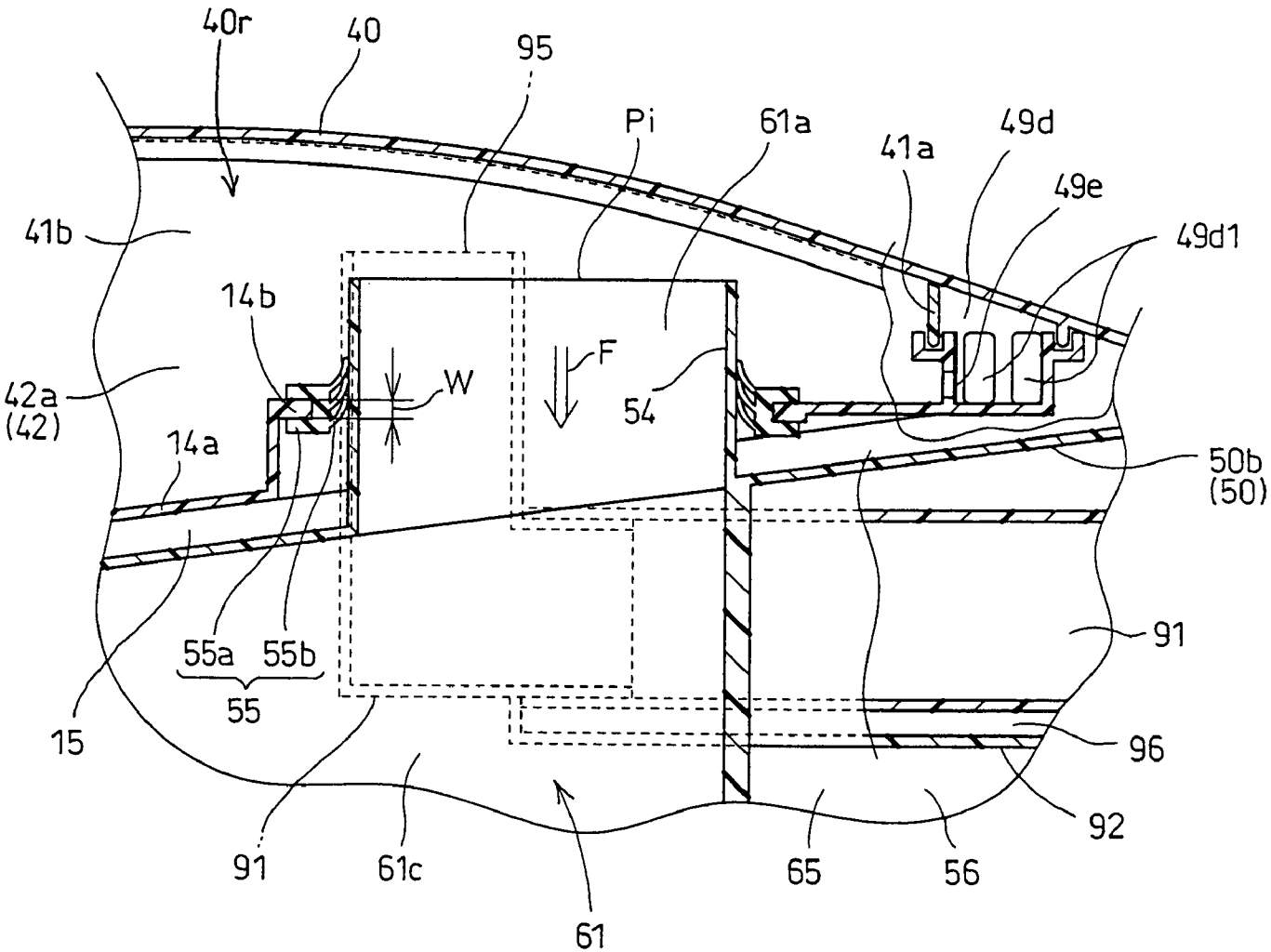
FIG. 7 is an enlarged view of a part, including an intake duct of an intake system, of FIG. 2.

The air intake structure Ai and the air exhaust structure Ae are provided with drain passages for draining water collected in the air intake space 42 and the air exhaust space 43 to the outside of the outboard motor S. The drain passage formed in the air intake structure Ai has a rear drain passage 49*a* (FIG. 5) formed in the lowermost part of the air inlet 44, and a front drain passage 49*b* formed in the front wall 41*a* and the top wall 14*a*. When the outboard motor S is tilted up, water is drained through the front drain passage 49*b*. Referring also to FIG. 7, the drain passage formed in the air exhaust structure Ae includes a rear drain passage 49*c* (FIG. 5), and a front drain passage 49*d* (FIGS. 2 and 6) formed in the front wall 41*a* and the top wall 14*a*. When the outboard motor S is tilted up, water is drained through the front drain passage 49*d*. The front drain passages 49*b* and 49*d* have openings 49*b*1 and 49*d*1, respectively. The openings 49*b*1 and 49*d*1 open into the atmosphere. The front drain passages 49*b* and 49*d* are provided with one-way valves 49*e*, respectively. One-way valves 49*e* allow water to flow out only from the air intake space 42 and the air exhaust space 43. Each of the one-way valves 49*e* is, for example, a reed valve provided with a flexible valve element formed by processing a thin sheet.

Referring to FIG. 2, the intake system N forming the intake air passage P for carrying the combustion air from the air intake space 42 into the combustion chambers 30 is joined to the upper end of the cylinder block 1. As shown in FIGS. 2 and 3, the intake system N includes an intake silencer 50 disposed above the engine body Ea, a reversing pipe 51 for reversing the flowing direction of the combustion air, a throttle device 52 provided with a throttle valve 52*a* for controlling the flow of the combustion air that has flowed through the reversing pipe 51, and an intake manifold 53. The reversing pipe 51 is connected to the intake silencer 50, disposed behind the engine body Ea and bent in a U-shape in a vertical plane (FIG. 5). The throttle device 52 is disposed above the engine body Ea. The intake manifold 53 is disposed between the reversing pipe 51 and the engine body Ea with respect to the longitudinal direction. The intake silencer 50 includes the lower case 50*a* (FIG. 2) covering the transmission mechanism 34, and an upper case 50*b* (FIG. 7) hermetically fastened to the lower case 50*a* with screws. The intake manifold 53 is disposed over and attached to both the right and left cylinder heads 3.

Referring to FIG. 7, the intake silencer 50 defines an intake silencing chamber including an upstream first silencing chamber 61 into which the intake air inlet Pi of the intake air passage P opens, and a second silencing chamber 65 on the downstream side of the first silencing chamber 61. The intake silencer 50 is an interior intake silencer located within the engine compartment 15, and the first and second silencing chambers 61 and 65 are interior silencing chambers provided within the engine compartment 15 to form a part of the intake air passage P.

Referring to FIG. 5, the reversing pipe 51 is a one-piece member and forms a first down passage 62 in which the combustion air coming from the first silencing chamber 61 flows down, a first reversing passage 63 in which the flowing direction of the combustion air that has flowed down through the first down passage 62 is reversed in a vertical plane such that the combustion air flows upward, and an up passage 64 in which the combustion air coming from the first reversing passage 63 flows upward. As shown in FIG. 2, the throttle device 52 forms a throttle passage 66 in which the throttle valve 52*a* is disposed. The combustion air that has flowed through the up passage 64 and the second silencing chamber 65 (FIG. 7) flows into the throttle passage 66. The intake manifold 53 forms a manifold passage 67 (FIG. 2) having a pair of distribution chambers, namely, a second down passage through which the combustion air that has been metered by the throttle valve 52*a* and has flowed through the throttle passage 66 flows down. The opening of the throttle valve 52*a* is controlled by a throttle operating mechanism. The combustion air that has flowed through the manifold passage 67 flows through the intake air outlets Pe (FIG. 5) of the intake air passage P, and the intake ports 31 of the engine body Ea into the combustion chambers 30.

The first silencing chamber 61 is defined by the first intake silencer formed by only the upper case 50*b* right above the engine body Ea and the transmission mechanism 33 and forms an upstream part of the intake air passage P. As shown in FIG. 3, the first silencing chamber 61 has an inlet part 61*a* defined by a cylindrical intake duct 54, an outlet part 61*b* connecting with an inlet part 62*a* of the first down passage 62, and an expansion chamber 61*c* of a passage area greater than those of the inlet part 61*a* and the outlet part 61*b*. As shown in FIG. 2, the cylindrical intake duct 54 extends upward through the top wall 14*a* of the upper cover 14 into the first space 42*a*. Thus the intake duct 54 or the inlet part 61*a* extends between the exterior of the engine compartment 15 and the interior of the same.

The inlet part 61*a* has the intake air inlet Pi. The intake air inlet Pi does not open into the engine compartment 15 and opens into the first space 42*a* which is outside the engine compartment 15. Referring FIGS. 6 and 7, the intake duct 54 through which the combustion air from the first space 42*a* flows down, and a receiving ring 14*b* formed integrally with the upper cover 14 and receiving an end part of the intake duct 54 overlap each other with respect to a flowing direction F in which the combustion air flows to form an overlapping part W. The overlapping part W is provided with an annular sealing member 55 to seal the gap between the engine compartment 15 and the first space 42*a*. The intake duct 54 extends upward through the receiving ring 14*b* into the first space 42*a*.

The sealing member 55 has a base 55*a* hermetically engaged with the receiving ring 14*b* defining a circular opening for receiving the intake duct 54, and annular, flexible lips 55*b* extending from the base 55*a* toward the intake duct 54 and in close contact with the outside surface of the intake duct 54. In this embodiment the number of the flexible lips 55*b* is three. The flexible lips 55*b* are arranged in the flowing direction F.

The sealing function of the sealing member 55 becomes effective when the upper cover 14 is put from above on the intake system N attached to the engine body Ea fixed to the mount case 10, and the end part of the intake duct 54 is received in the receiving ring 14*b* to form the overlapping part W.

Referring also to FIG. 2, the upper cover 14 is guided by the locking devices 16 and moves to its working position where the upper cover 14 is joined to the lower cover 13 before the overlapping part W is formed, and the receiving ring 14*b* receives the end part of the intake duct 54 to form the overlapping part W. More concretely, the locking devices 16 guide the upper cover 14 toward the lower cover 13 when the upper cover 14 is moved to join the same to the lower cover 13 fixed to the engine body Ea such that the axis of the receiving ring 14*b* of the upper cover 14 is aligned with the vertical axis of the intake duct 54 of the intake system N attached to the cylinder block 1, and the receiving ring 14*b* moves vertically toward the intake duct 54 along the vertical axis of the intake duct 54. Thus the overlapping part W is formed and the sealing member 55 is closely engaged with the intake duct 54 and the receiving ring 14*b* when the upper cover 14 is joined to the lower cover 13.

Thus the intake duct 54 cooperates with the receiving ring 14*b* of the upper cover 14 of the intake silencer 40*s* to form a separable connecting structure so that the intake silencer 40*s* can be detachably connected to the intake system N. The detachable connecting structure includes the overlapping part W and the sealing member 55.

Referring to FIGS. 3 and 5, the first down passage 62 formed at the rear of the engine body Ea has an inlet part 62*a* connected to the outlet part 61*b* at a position above the engine body Ea, and a vertical down part 62*c* of a cross-sectional area greater than that of the inlet part 62*a*. The combustion air flowing substantially horizontally rearward through the outlet part 61*b* and the inlet part 62*a* flows downward through the down part 62*c*

The up passage 64 formed at the rear of the engine body Ea has an outlet part 64*b* at substantially the same position as the inlet part 62*a* with respect to the vertical direction, and a vertical up part 64*c* of a cross-sectional area greater than that of the outlet part 64.

The up passage 64 and the first down passage 62 are substantially symmetrical with respect to a vertical plane containing the center axis Le of the crankshaft 7 and perpendicular to the lateral direction on the outboard motor S.

The reversing passage 63 formed at the rear of the engine body Ea reverses the flowing direction of the combustion air flowing downward at a position overlapping the engine body Ea with respect to the vertical direction to make the combustion air flow upward. A drain passage 68 is connected to a bottom part of the reversing pipe 51 so as to communicate with a bottom part 63*d* of the reversing passage 63. The drain passage 68 opens into the engine compartment 15 in the flowing direction of the combustion air in the bottom part 63*d*. The drain passage 68 is provided with a one-way valve 68*e* (FIG. 5) that is opened by the weight of water collected in the bottom part 63*d* to permit only discharging the water into the engine compartment 15. The one-way valve 68*e*, similarly to the one-way valve 49*c*, is a reed valve.

The first down passage 62, the reversing passage 63 and the up passage 64 form a U-shaped passage as viewed in a longitudinal direction. The U-shaped passage extending down from the inlet part 62*a* above the upper end of the engine body Ea to the lower end of the engine body Ea, curves in an upwardly concave U-shape and extends upward to the outlet part 64*b* above the upper end of the engine body Ea. The combustion air flowing through the intake air passage P flows downward first, and then flows upward between the first silencing chamber 61 and the second silencing chamber 65. The first down passage 62, the reversing passage 63 and the up passage 64 form a water separating unit. Water contained in combustion chamber is separated from the combustion air by centrifugal force while the combustion air is flowing through the reversing passage 63. Therefore, the first silencing chamber 61 and the second silencing chamber 65 are disposed on the upstream side and the downstream side, respectively, of the water separating unit.

Referring to FIG. 3, the second silencing chamber 65 of the second intake silencer is made up of the lower case 50*a* and the upper case 50 and is disposed right above the engine body Ea and the transmission mechanisms 33 and 34. The second silencing chamber 65 has an inlet part 65*a* connected to the outlet part 64*b*, an outlet part 65*b* connected to the throttle passage 66, and an expansion part 65*c* of a cross-sectional area greater than those of the inlet part 65*a* and the outlet part 65*b*.

Figure 8:
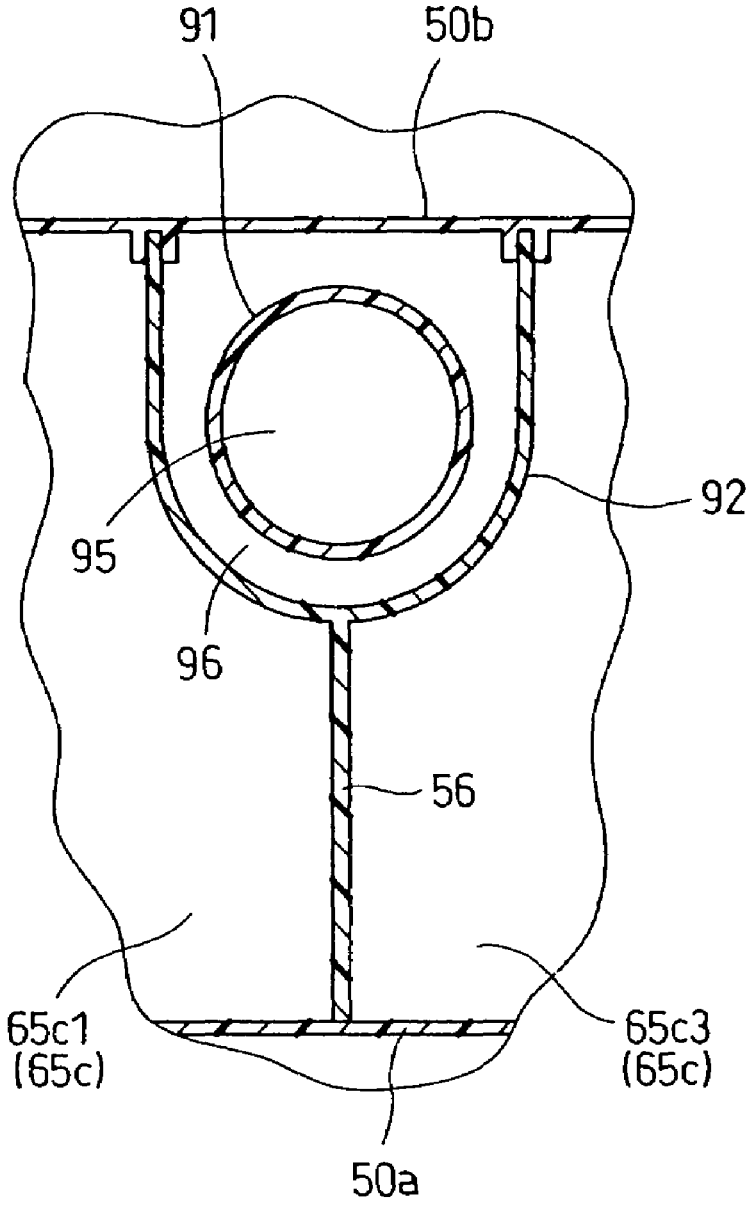
FIG. 8 is a sectional view taken on the line VIII-VIII in FIG. 7.

Referring to FIG. 8, the expansion chamber 65*c* is divided by a partition wall 56 extending downward and forward from the upper case 50*b* into a front passage 65*c*1 through which the combustion air from the inlet part 65*a* flows forward, a reversing part 65*c*2 (FIG. 3) in which the flowing direction of the combustion air is reversed, and a rear passage 65*c*3 through which the combustion air flows rearward to the outlet part 65*b*. Thus the second silencing chamber 65 serves as a second reversing passage for reversing the flowing direction of the combustion gas flowing in the forward direction in a horizontal plane. The partition wall 56 is formed integrally with a separator wall 92 and is attached to the intake silencer 50.

A flame arrester 57 is disposed on the upstream side of the outlet part 65*b*. The flame arrestor 57 is provided with a wire net that plays a quenching function when back fire occurs.

The throttle device 52 has a throttle body 52*b* defining the throttle passage 66 and connected by a flexible conduit 58 to the outlet part 65*b*. The throttle valve 52*a* is disposed in the intake air passage P on the downstream side of the up passage 64 and on the upstream side of the second down passage 67. Thus the throttle valve 52*a* is on the downstream side of the water separating unit. As shown in FIGS. 3 and 5, in the intake air passage P, the outlet part 61*b*, namely, an inlet passage having an upstream end connecting with the inlet part 62*a* of the first down passage 62, and the inlet part 65*a*, namely, an outlet passage having a downstream end connecting with the outlet part 64*b* of the up passage 64 are on the opposite sides, respectively, of the throttle device 52 as seen in plan view. The inlet parts 62*a* and 65*a*, and the outlet parts 61*b* and 64*b* are substantially horizontal passages.

Referring to FIGS. 2 and 5, the manifold passage 67, namely, an outlet part of the intake air passage P, has an inlet part 67*a* into which the combustion air from the throttle passage 66 flows, a pair of distribution chambers 67*c* separated by a partition wall 53*a*, branching off from the inlet part 67*a* and respectively corresponding to the banks 1*b* and 1*c* (FIG. 3), and three runner passages 67*b* branching off from each of the distribution chambers 67*c*. The partition wall 53*a* is provided with shutoff valves 53*b* that opens or closes depending on engine speed. The shutoff valves 53*b* close to disconnect the distribution chambers 67*c* while engine speed is in a low speed range to improve volumetric efficiency by resonance supercharge. The shutoff valves 53*b* open to connect the distribution chambers 67*c* while engine speed is in a high speed range to improve volumetric efficiency by inertia supercharge.

Each of the runner passages 67*b* has an intake air outlet Pe at its downstream end. In the manifold passage 67, the combustion air flows from the distribution chambers 67*c* through the runner passages 67*b* and the intake ports 31 into the combustion chambers 30. In FIG. 5, the manifold passage 67 is indicated by broken lines, and the intake ports 31 and the combustion chambers 30 are indicated by chain lines for convenience. The upper end of the up passage 64 is at a level higher than that of the uppermost intake air outlet Pe1 at the highest position among the intake air outlets Pe.

Referring to FIGS. 2, 3 and 5, the intake air passage P extends continuously from the intake air inlet Pi to the intake air outlets Pe in the engine compartment 15. The intake air passage P has the first silencing chamber 61, the first down passage 62, the reversing passage 63, the up passage 64, the second silencing chamber 65, the throttle passage 66 and the distribution chambers 67*c*, namely, down passages, arranged in that order from the upstream end to the downstream end. The combustion air taken in through the air inlet 44, the first space 42*a* and the intake air inlet Pi flows down through the duct 54, flows rearward in a horizontal plane through the expansion part 61*c*, flows rearward through the outlet part 61*b* and the inlet part 62*a* in a horizontal plane, flows down through the down part 62*c*, the flowing direction of the combustion air is reversed by the reversing passage 63 so that the combustion air flows upward through the up part 64*c* to a position at a level higher than that of the uppermost intake air outlet Pe1, flows forward in a horizontal plane through the outlet part 61*b* and the inlet part 65*a*, flows rearward through the second silencing chamber 65, flows rearward in a horizontal plane through the outlet part 65*b* and the throttle passage 66, and flows down through the distribution chambers 67*c*. Then the combustion air flows through the intake air outlets Pe of the runner passages 67*b* and the intake ports 31 into the combustion chambers 30.

The ventilation system 70 for carrying air in the second space 42*b* as ventilating air into the engine compartment 15 is disposed behind the engine body Ea and near the cylinder head 3. The ventilation system 70 includes the ventilation duct 71 defining an inlet passage 76 (FIG. 5) having an air inlet 75 (FIG. 6), and guide ducts 72 (FIGS. 3 and 5) defining right and left guide passages 77 on the laterally opposite sides, respectively, of the first down passage 62 and the up passage 64. Each of the guide passages 77 has an air outlet 78 opening downward in the engine compartment 15 at a position corresponding to the engine body Ea and the reversing passage 63 with respect to the vertical direction. The guide ducts 72 is attached to brackets 73 (FIG. 3) fastened to the head cover 4.

The ventilation air that has flowed down through the guide passages 77 into the engine compartment 15 cools the engine body Ea, the intake system N and the exhaust manifold 25 installed in the engine compartment 15. Then, most part of the ventilation air is sucked as cooling air into the alternator G attached to a brackets 2*a* (FIG. 1) fastened to the crankcase 2 on the front end of the engine body Ea. The ventilation system N and the alternator G are disposed at the rear and the front end, respectively, of the engine body Ea. The engine body Ea is cooled substantially entirely by the ventilation air that flows forward from behind the engine body Ea. Thus the ventilation air used efficiently as the cooling air flows into the alternator G.

Referring to FIGS. 1 to 3, the alternator G has the shaft 81 (FIG. 3) driven for rotation by the crankshaft 7, and a housing 82 housing a rotor fixedly mounted on the shaft 81 and a stator. The rotor is provided with cooling air blades (fan) for taking air into the housing 82. The housing 82 is provided with air inlets 83 through which cooling air taken by the fan flows into the housing 82, and air outlets 84 through which the cooling air used for cooling the alternator G is discharged from the housing 82. A louver 85 placed on the lower case 50*a* straightens the flow of the ventilation air. The straightened ventilation air flows through the air inlets 83 into the housing 82.

Exhaust air discharged through the air exit 47 flows scarcely into the engine compartment 15, is guided by an exhaust air guide structure 90 (FIG. 2) to the exhaust structure Ae, and then is discharged to the outside of the outboard motor S.

Referring to FIGS. 2, 3 and 6 to 8, the exhaust air guide structure 90 includes an exhaust air duct 91 (FIG. 2) defining an exhaust air passage 95 (FIG. 3) surrounding the air exit 47 to guide exhaust air to a predetermined position from which the exhaust air is hardly able to flow again through the air inlets 83 into the housing 82 of the alternator G. The exhaust air guide structure 90 also includes a separator wall 92 for separating the exhaust air duct 91 extending down from the upper case 50*b* through the intake silencer 50, from the second silencing chamber 65. A condition where the exhaust air is carried to the predetermined position can more effectively suppress or prevent the flow of the exhaust air again through the air inlets 83 into the housing 82 than a condition without the exhaust air duct 91. In this embodiment, the predetermined position is in the air exhaust space 43 (FIG. 6) outside the engine compartment 15, and the exhaust air passage has an outlet 95*b* opening into the air exhaust space 43. A heat insulating space 96 (FIG. 3) defined by the separator wall 92 and the upper case 50*b* is formed between the exhaust air passage 95 and the second silencing chamber 65, and the exhaust air duct 91 is made to extend in the heat insulating space 96. Since the heat insulating space 96 is formed between the exhaust air passage 95 and the second silencing chamber 65, the combustion air flowing through the second silencing chamber 65 is prevented or suppressed from being heated by the heat of exhaust air from the alternator G.

The alternator G serves also as an exhaust fan that discharges the ventilation air passing through the engine compartment 15 to the outside of the engine compartment 15 in a manner separated from the combustion air.

The operation and effect of the foregoing embodiment will be explained.

The intake air passage P of the internal combustion engine E incorporated into the outboard motor S extends continuously from the intake air inlet Pi to the intake air outlets Pe in the engine compartment 15. The intake air passage P has the first down passage 62, the reversing passage 63, the up passage 64 and the distribution chambers 67*c* arranged in that order in the flowing direction of the combustion air. The combustion air taken through the intake air inlet Pi into the intake air passage P flows down through the first down passage 62, the flowing direction of the combustion air is reversed by the reversing passage 63 so that the combustion air flows upward, and then the combustion air flows up through the up passage 64 to a position at a level higher than that of the intake air outlet Pe1 at the highest position among the intake air outlets Pe, flows down through the distribution chambers 67*c*, and then flows through the intake air outlets Pe into the combustion chambers 30. Therefore, water contained in the combustion air that has flowed through the intake air inlet Pi into the intake air passage P is separated from the combustion air by centrifugal force as the combustion air flows through the curved reversing passage 63. The combustion air that has passed through the reversing passage 63 flows to the position at the level higher than that of the intake air outlet Pe1 at the highest position among the intake air outlets P3. The combustion air flows down through the distribution chambers 67*c* and flows through the intake air outlets Pe into the combustion chambers 30. Thus water can be surely separated from the combustion air while the combustion air is flowing up through the up passage 64 after the flowing direction of the combustion air has been reversed, as compared with a state where the combustion air flows out through intake air outlets formed in intermediate parts of the up passage below the upper end of the up passage. Consequently, the water trapping effect is improved. When the intake air passage P is provided with the plural intake air outlets Pe, the water trapping effect of the air intake air passage P is satisfactory with all the combustion chambers 30 regardless of the positions of the intake air outlets Pe.

The intake air inlet Pi does not open into the engine compartment 15 and opens directly into the air intake space 42 outside the engine compartment 15. Therefore, hot air heated in the engine compartment 15 does not flow through the intake air inlet Pi into the intake air passage P. Thus the rise of the temperature of the combustion air can be suppressed, the charging efficiency is improved, and the generation of noise by the engine cover C due to intake pulsation can be prevented because the pressure of air in the engine compartment is not caused to vary by the intake pulsation.

The throttle valve 52*a* of the intake system N is disposed in the intake air passage P on the downstream side of the up passage 64 or the water separating unit and on the upstream side of the distribution chambers 67*c*. Since the throttle valve 52*a* controls the flow of the combustion air from which water has been separated in the reversing passage 63 and the up passage 64, the throttle valve 52*a* is prevented from being wetted with water. When the combustion air contains salt water, adhesion of salt to the throttle valve 52*a* can be prevented.

In the intake air passage P, the inlet part 62*a* of the first down passage 62 or the outlet part 61*b*, and the outlet part 61*b* of the up passage 64 or the inlet part 65*a* are on the opposite sides, respectively, of the throttle valve 52*a* or the throttle device 52 as seen in plan view. Thus the throttle valve 52*a* or the throttle device 52 is disposed in the space between the inlet part 62*a* or the outlet part 61*b*, and the outlet part 64*b* or the inlet part 65*a*. Therefore, the throttle valve 52*a* or the throttle device 52, and the intake air passage P can be formed in a compact arrangement. The down part 62*c* of the first down passage 62 and the up part 64*c* of the up passage 64 can be formed in increased widths and large cross-sectional areas, respectively, by using the space, whereby the water separating effect is enhanced by reducing the flowing speed of the combustion air in the down part 62*c* of the flow passage 62. An expansion silencing function can be imparted to the first down passage 62, the reversing passage 63 and the up passage 64, which contributes to reducing intake noise.

The intake silencer of the outboard motor S including the first silencing chamber 61 and the second silencing chamber 65 disposed respectively on the upstream and the downstream side of the water separating unit has an excellent intake noise reducing effect.

The intake air passage P is a passage within the engine compartment 15, extending continuously from the intake air inlet Pi to the intake air outlets Pe, and the intake silencing chamber 40*r* communicating with the intake air inlet Pi is disposed outside the engine compartment 15, while the intake silencing chamber 61 constituting part of the intake air passage P is disposed in the engine compartment 15. Thus the plural intake silencing chambers including the intake silencing chamber 40*r* and the intake silencing chamber 61 are arranged in such a disposition allotted in both the inside and outside of the engine compartment 15. This arrangement enables increasing the total number of the intake silencing chambers to be provided on the engine E without increasing the number of the intake silencing chambers in the engine compartment 15, thereby preventing the engine cover C from becoming enlarged in size and further reducing the intake noises due to the provision of the plural intake silencing chambers. Thus a small-sized outboard motor having a low intake noise level can be obtained.

The intake duct 54 extends through the top wall 14*a* of the upper cover 14 into the first space 42*a*. The extension of the intake duct 54 into the first space 42*a* enables arrangement of the intake silencing chambers 40*r* and 61 in mutually adjacent disposition in vertical direction with the top wall 14*a* of the upper cover 14 disposed between the two silencing chambers, so that the intake silencing chambers 40*r* and 61 can be arranged in vertically compact disposition. Thus the intake silencing chambers 40*r* and the engine E can also be arranged in compact disposition, serving to reduce the size of the outboard motor S.

The intake silencing chambers 40*r* is formed by the intake silencing chambers 40*s*, the inlet part 61*a* of the first silencing chamber 61 is formed by the intake duct 54, and the intake duct 54 cooperates with the intake silencer 40*s* to form the separable connecting structure so that the intake silencer 40*s* can be separably connected with the intake system N or the intake silencer 50. Thus the intake silencer 40*s* is separable from the intake silencing chambers 40*r* in the intake duct 54, whereby it is easy for the intake silencing chambers 40*r* and 61 to be separated with resultant improvement in maintenance work.

The separable connecting structure includes the sealing member 55 that provides a hermetical seal between the exterior and interior of the engine compartment 15, so that intake pulsation within the intake air passage P is prevented from being transmitted to the air in the engine compartment 15. Thus vibrations of the engine cover C due to air pressure variations in the engine compartment 15 that is caused by the intake pulsation are prevented with resultant reduction in the level of noises of the engine cover C that are produced by the intake pulsation.

The intake air inlet Pi of the intake duct 54 of the intake system N is connected to the first space 42*a* of the air intake space 42, and the sealing member 55 placed in the overlapping part W where the receiving ring 14*b* of the upper cover 14 and the end part of the intake duct 54 overlap each other with respect to the flowing direction F in which the combustion air flows to seal the gap between the engine compartment 15 and the external space. Therefore, even if the intake duct 54 and the receiving ring 14*b* vibrate and move relative to each other in directions parallel to the flowing direction F, the gap between the intake duct 54 and the engine cover C can be sealed by the sealing member 55 by forming the intake duct 54 and the receiving ring 14*b* in sizes such that the overlapping part W can be formed. Thus the components of the sealing structure do not need to be formed in high dimensional accuracy and the sealing performance of the sealing structure is scarcely subject to vibrations. Since the gap between the intake duct 54 and the engine cover C can be stably sealed, noise generation by the engine cover C due to intake pulsation can be surely prevented.

The engine cover C includes the lower cover 13 fixed to the engine body Ea holding the intake system N, and the upper cover 14 which is guided by the locking device 16 serving as positioning devices to the joining position and detachably joined to the lower cover 13. The sealing member 55 is put on the receiving ring 14*b*. The upper cover 14 provided with the receiving ring 14*b* is guided toward the lower cover 13 by the locking devices 16, and the intake duct 54 is received in the receiving ring 14*b* to form the overlapping part W upon the arrival of the upper cover 14 at the joining position. Thus the locking devices 16 guide the upper cover 14 toward the lower cover 13 to join the upper cover 14 to the lower cover 13 to position the receiving ring 14*b* of the upper cover 14 at the position for forming the overlapping part W, the overlapping part W is formed by guiding the upper cover 14 by the locking device 16 to the joining position. When the overlapping part W is thus formed, the sealing member 55 comes into close contact with the intake duct 54 and the receiving ring 14*b* to complete a sealing structure. Thus the sealing structure can be easily formed.

In the engine compartment 15 of the outboard motor S, the shaft 81 of the alternator G is disposed with its center axis Lg spaced the predetermined center distance d apart from the center axis Le of the crankshaft 7. The exhaust air duct 91 surrounds the outlets 84 of the housing 82 of the alternator G and carries the exhaust air to the predetermined air exhaust space 43 from which the exhaust air is hardly able to flow again through the air inlets 83 into the housing 82. Therefore, it is prevented for the exhaust air, which is discharged from the alternator G and has scarcely undergone temperature drop, to flow again into the alternator G. For this reason, the alternator G disposed in the engine compartment 15 and having the shaft 81 at the center distance d from the output shaft of the internal combustion engine E can be efficiently cooled.

The exhaust air duct 91 carries the exhaust air to the air exhaust space 43 outside the engine compartment 15. Therefore, heating the combustion air by the exhaust air can be suppressed to suppress the reduction of the charging efficiency.

The ventilation air and the combustion air flow separately into the engine compartment 15, and the alternator G serves as an exhaust fan for discharging the ventilation air to the outside of the engine compartment 15. Since the alternator G serves also as the exhaust fan, an exhaust fan especially for ventilation is unnecessary. Thus the engine compartment 15 can be efficiently ventilated without requiring additional parts, and the internal combustion engine E, devices and the members installed in the engine compartment 15 can be efficiently cooled. Since the ventilation air and the combustion air flow separately into the engine compartment 15, the flow of the combustion air taken in by the intake system N will not be affected by the ventilation air even if ventilation is promoted.

Modifications of the foregoing embodiment will be described.

The above described embodiment is provided with one intake silencer outside the engine compartment. However, more than two intake silencers could be provided outside the engine compartment. Further, the intake silencer having the intake silencing chambers could be made detachable from the intake system or the engine together with the engine cover.

The intake duct does not extend through the receiving ring. When the receiving ring is cylindrical, the intake duct may be fitted on the receiving ring. When the intake duct is fitted on the receiving ring, the sealing member may be held between the inside surface of the intake duct and the outside surface of the receiving ring.

The sealing member 55 may be combined with at least either of the intake duct 54 and the receiving ring 14*b*.

The internal combustion engine E may be an in-line multicylinder internal combustion engine or a single-cylinder internal combustion engine. When a single-cylinder internal combustion engine has a single intake air outlet, the single intake air outlet corresponds to the uppermost intake air outlet.

The internal combustion engine may be applied to marine propulsion machines (for example, inboard or outboard) or machines other than the marine propulsion machines, such as vehicles and working machines.

What is claimed is:

1. In an outboard motor having an external engine cover, the improvement comprising an internal combustion engine installed in an engine compartment defined by the engine cover, said internal combustion engine comprising an engine body having a combustion chamber formed therein, and an intake system having an intake air passage with an intake air inlet and an intake air outlet to carry combustion gas to the combustion chamber, the intake system comprising an intake air routing structure provided inside of the engine cover which is configured and arranged to keep air in the intake air passage separate from ventilation air flowing past the engine in the engine compartment, wherein:

the intake air inlet is formed by an air intake duct and is in communication with an exterior of the engine compartment;

the engine cover is formed with a receiving ring which is fitted on the air intake duct;

the receiving ring and the intake duct cooperate to form an overlapping part in which the receiving ring and the intake duct overlap each other in a direction of flow of combustion air;

the overlapping part has a sealing member therein which forms a seal between an exterior of the engine compartment and an interior of the engine compartment;

the engine cover is detachably attached to the outboard motor in a manner guided by a stationary positioning member, the sealing member is provided on at least one of the intake duct and the receiving ring, and the internal combustion engine is configured and arranged such that the engine cover is guided by the positioning guide member to cause the receiving ring to fit on the intake duct to form the overlapping part when the engine cover reaches a predetermined position.

2. The internal combustion engine according to claim 1, wherein the sealing member includes a base part and flexible lips formed on the base part, and the base part is fitted on the receiving ring and the flexible lips are in sealing contact with the intake duct.

3. The internal combustion engine according to claim 2, wherein the receiving ring is positioned outside the intake duct.

4. The internal combustion engine according to claim 1, wherein the air intake duct extends through the engine cover to the exterior of the engine compartment.

5. The internal combustion engine according to claim 1, further comprising an exterior cap member which fits on to an upper portion of the engine cover to protectively shield the receiving ring and the air intake duct which defines the intake air inlet.

6. The internal combustion engine according to claim 1, wherein the intake air routing structure comprises a substantially U-shaped reversing pipe for reversing a direction of air flowing therethrough.

7. The internal combustion engine according to claim 6, wherein the reversing pipe includes a first portion configured to route air downwardly as it passes therethrough, a second portion configured to substantially reverse a direction of airflow therethrough, and a third portion configured to route air upwardly as it passes therethrough.

8. The internal combustion engine according to claim 1, wherein the engine cover comprises:

a first cover secured to the engine body to which the intake system is attached, and a second cover detachably attached to the first cover at said predetermined position in a manner guided by the positioning member, and wherein the receiving ring is provided on the second cover.

9. An outboard motor comprising an internal combustion engine and an external engine cover substantially surrounding the engine and defining an engine compartment therein, said internal combustion engine comprising:

an engine body having a combustion chamber formed therein, and an intake system having an intake air passage with an intake air inlet and an intake air outlet to carry combustion gas to the combustion chamber, the intake system comprising an intake air routing structure provided inside of the engine cover which is configured and arranged to keep air in the intake air passage separate from ventilation air flowing past the engine in the engine compartment, wherein:

the intake air inlet is formed by an air intake duct and is in communication with an exterior of the engine compartment;

the engine cover is formed with a receiving ring which is fitted on the air intake duct, the receiving ring positioned outside of and surrounding the intake duct;

the receiving ring and the intake duct cooperate to form an overlapping part in which the receiving ring and the intake duct overlap each other in a direction of flow of combustion air, and further comprising a sealing member disposed in the overlapping part, the sealing member forming a seal between an exterior of the engine compartment and an interior of the engine compartment, the sealing member including a base part and a plurality of flexible lips formed on the base part, and wherein the base part is fitted on the receiving ring and the flexible lips are in sealing contact with an exterior surface of the intake duct, wherein the intake air routing structure comprises a substantially U-shaped reversing pipe for reversing a direction of air flowing therethrough.

10. The internal combustion engine according to claim 9, wherein the air intake duct extends through the engine cover to the exterior of the engine compartment.

11. The internal combustion engine according to claim 9, further comprising an exterior cap member which fits on to an upper portion of the engine cover to protectively shield the receiving ring and the air intake duct which defines the intake air inlet.

12. The internal combustion engine according to claim 9, wherein the reversing pipe includes a first portion configured to route air downwardly as it passes therethrough, a second portion configured to substantially reverse a direction of airflow therethrough, and a third portion configured to route air upwardly as it passes therethrough.

13. An outboard motor comprising an internal combustion engine and an external engine cover substantially surrounding the engine and defining an engine compartment therein, said internal combustion engine comprising:

an engine body having a combustion chamber formed therein, and an intake system having an intake air passage with an intake air inlet and an intake air outlet to carry combustion gas to the combustion chamber, the intake system comprising an intake air routing structure provided inside of the engine cover which is configured and arranged to keep air in the intake air passage separate from ventilation air flowing past the engine in the engine compartment, the intake air routing structure comprising a substantially U-shaped reversing pipe for reversing a direction of air flowing therethrough, wherein:

the intake air inlet is formed by an air intake duct and is in communication with an exterior of the engine compartment;

the engine cover is formed with a receiving ring which is fitted on the air intake duct;

the receiving ring and the intake duct cooperate to form an overlapping part in which the receiving ring and the intake duct overlap each other in a direction of flow of combustion air; and further comprising a sealing member disposed in the overlapping part, said sealing member forming a seal between an exterior of the engine compartment and an interior of the engine compartment.

14. The internal combustion engine according to claim 13, wherein the reversing pipe includes a first portion configured to route air downwardly as it passes therethrough, a second portion configured to substantially reverse a direction of airflow therethrough, and a third portion configured to route air upwardly as it passes therethrough.

15. The internal combustion engine according to claim 14, wherein:

the engine cover comprises a first cover secured to the engine body to which the intake system is attached, and a second cover detachably attached to the first cover at a predetermined position in a manner guided by a positioning guide member, the receiving ring is provided on the second cover, and the sealing member is provided on at least one of the intake duct and the receiving ring, the engine being configured and arranged such that the second cover is guided by the positioning guide member toward the first cover to cause the receiving ring to fit on the intake duct to form the overlapping part when the second cover reaches said predetermined position.

16. The internal combustion engine according to claim 14, wherein the sealing member includes a base part and flexible lips formed on the base part, and the base part is fitted on the receiving ring and the flexible lips are in sealing contact with the intake duct.

17. The internal combustion engine according to claim 14, wherein the air intake duct extends outwardly through the engine cover to the exterior of the engine compartment.

18. The internal combustion engine according to claim 14, further comprising an exterior cap member which fits on to an upper portion of the engine cover to protectively shield the receiving ring and the air intake duct which defines the intake air inlet.

* * * * *